US006878889B1

(12) United States Patent
Horst et al.

(10) Patent No.: US 6,878,889 B1
(45) Date of Patent: Apr. 12, 2005

(54) GARAGE DOOR OPENER SECURITY DEVICE

(76) Inventors: Richard R. Horst, 1804 Wilbur Dr., Modesto, CA (US) 95350; Sandra L. Horst, 1804 Wilbur Dr., Modesto, CA (US) 95350

( * ) Notice: Subject to any disclaimer, the term of this patent is extended or adjusted under 35 U.S.C. 154(b) by 0 days.

(21) Appl. No.: 10/196,799

(22) Filed: Jul. 15, 2002

(51) Int. Cl.[7] ..... H01R 51/00

(52) U.S. Cl. ..... 200/51; 200/557; 200/302.3; 200/157; 200/283; 49/13; 49/199; 49/263

(58) Field of Search ..... 200/51, 557, 302.3, 200/157, 283, 51.11, 51 R, 51.15; 49/13, 199, 263; 439/502

(56) References Cited

U.S. PATENT DOCUMENTS

| | | | | |
|---|---|---|---|---|
| 2,348,107 | A | 5/1944 | Brongersma | |
| 3,126,467 | A | 3/1964 | Stevens | |
| 3,469,164 | A | 9/1969 | Truemper | |
| 3,654,415 | A | 4/1972 | Hawkins | |
| 4,152,563 | A | 5/1979 | Bongort | |
| 4,635,802 | A | 1/1987 | Hylton | |
| 5,226,257 | A | 7/1993 | Moss | |
| D384,939 | S | 10/1997 | Schaffner | |
| 5,855,494 | A | 1/1999 | Blaszczyk | |
| 2003/0121619 | A1 * | 7/2003 | Szpur | 160/188 |

* cited by examiner

*Primary Examiner*—Elvin Enad
*Assistant Examiner*—Jennifer A. Poker
(74) *Attorney, Agent, or Firm*—Heisler & Associates

(57) ABSTRACT

A device is provided to prevent unauthorized opening of the garage door by interrupting the flow of electrical power to the automatic garage door opener. A power-interrupting switch, suspended from a desired overhead location in the garage, is interposed between the power source and garage door opener to selectively interrupt or complete the flow of electricity to the garage door opener. By interrupting the electrical flow, the garage door opener is deactivated and will remain unresponsive to a possible unauthorized remote control signal.

25 Claims, 2 Drawing Sheets

GARAGE DOOR OPENER SECURITY DEVICE

FIELD OF THE INVENTION

The present invention relates to security devices and methods, and particularly pertains to a garage door opener security device and method which provides a conveniently suspended switch for selectively actuating or deactuating the electrical power to a garage door opener by effectively completing and interrupting the flow of electricity between the garage door opener and the source of electricity for the garage door opener.

BACKGROUND OF THE INVENTION

Garage doors equipped with an automatic door opening and closing system are prevalent in the homes of the general populace. Garage door openers are provided to open and close the garage door. Typically, the openers are accompanied by a remote control to provide a signal for opening and closing of the door, especially from outside the garage.

The problem of preventing unauthorized activation of the garage door opener is a major concern for home owners. Thieves gain access to the house through the garage by activating the garage door opener with an unauthorized signal. The unauthorized signals come from remote controls used to activate other garage door openers and even used to activate other unrelated household appliances, such as a television.

A number of products have been developed in an attempt to disable automatic garage door openers in order to prevent unauthorized access. One such product is a locking device designed to be used with various well-known types of automatic openers, e.g. with an elongated, threaded screw-type opener drive train, as well as with a roller chain-type drive train. The locking device blocks any unauthorized opening of the garage door with a locking pin inserted between the rollers of the door's flanking guide tracks. The locking device may be actuated by an electrical signal, manual push-button, or the turn of a key.

In addition, some garage door openers include a kill switch to deactuate and de-energize the opener for extended periods of time. However, the kill switch is often placed inside the garage door opening mechanism, making it difficult to reach and see. Since the switch is often out-of-sight, the availability of its use as a security measure is forgotten.

Accordingly, there exists a need for a garage door opener security device that is not only affordable and easy to activate, but one that prompts a person through accessibility and visibility to activate the device on a regular basis.

SUMMARY OF THE INVENTION

The present invention is a garage door opener security device and method of use provided for the prevention of unauthorized activation of a garage door opener. Such unauthorized activation is prevented by interrupting the flow of electricity from a power source to the garage door opener when the remote control is not needed, such as when the homeowner is at home. A power-interrupting switch interposed along the electrically conductive pathway between the power source and the garage door opener selectively interrupts the electrical power. The switch is conveniently suspended from an overhead location to place the switch at a desired location within reach of the user for convenient use. Once the switch is suspended from above the desired location, the length of suspension may be adjusted to position the switch where desired, as well.

In a preferred embodiment of the present invention the garage door opener security device is connected to the power source via a power cord at the first end of the electrically conductive pathway. At the second end of the electrically conductive pathway, the device is connected to the garage door opener via a connector cord. A junction box is located between the power cord and the connector cord. The junction box houses the wiring to connect the power cord to the connector cord. The power-interrupting switch is suspended from the junction box by a conductor cord. The conductor cord length may be adjusted to successfully suspend the switch at a desired overhead location.

OBJECTS OF THE INVENTION

Accordingly, a primary object of the present invention is to provide a garage door opener security device and method that prevents unauthorized and unlawful entry to the garage.

Another object of the present invention is to prevent unauthorized actuation of the garage door opener by an unauthorized wireless signal.

Another object of the present invention is to provide a garage door opener security device and method that prompts a user to activate the invention through its accessibility, visibility and ease of use.

Another object of the present invention is to provide a garage door opener security device and method that accommodates users of various heights.

Another object of the present invention is to provide a system to deactuate the power supply to the garage door opener to conserve energy.

Another object of the present invention is to provide a garage door opener security device which may be easily and efficiently manufactured and marketed.

Another object of the present invention is to provide a garage door opener security device that is economical and available to consumers.

Another object of the present invention is to provide a garage door opener security device and method that works with most, if not all, available electric garage door openers.

Other further objects of the present invention will become apparent from a careful reading of the included drawing figures, the claims and detailed description of the invention.

DESCRIPTION OF THE PREFERRED EMBODIMENT

Figure 1:
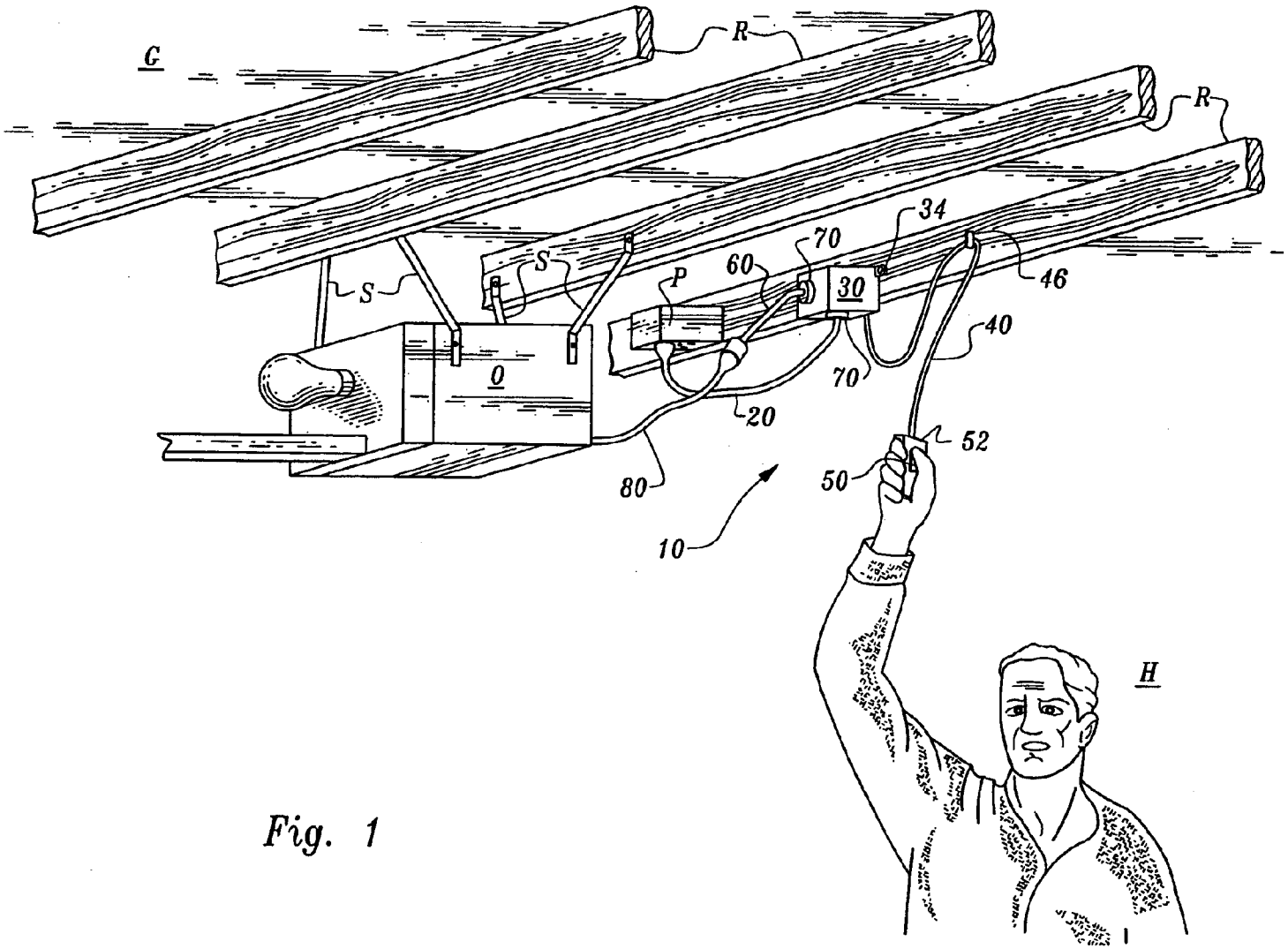
FIG. 1 is a perspective view of the invention in use with the power-interrupting switch adjustably suspended at a desired overhead location.

Referring to the drawings, wherein like reference numerals represent like parts throughout the various drawing figures, reference numeral 10 is directed to a garage door opener security device. The security device 10 has a power cord 20, junction box 30, conductor cord 40, power-interrupting switch 50 and connector cord 60 which act together to allow an operator H to selectively disable a garage door opener O.

Figures 2, 3:
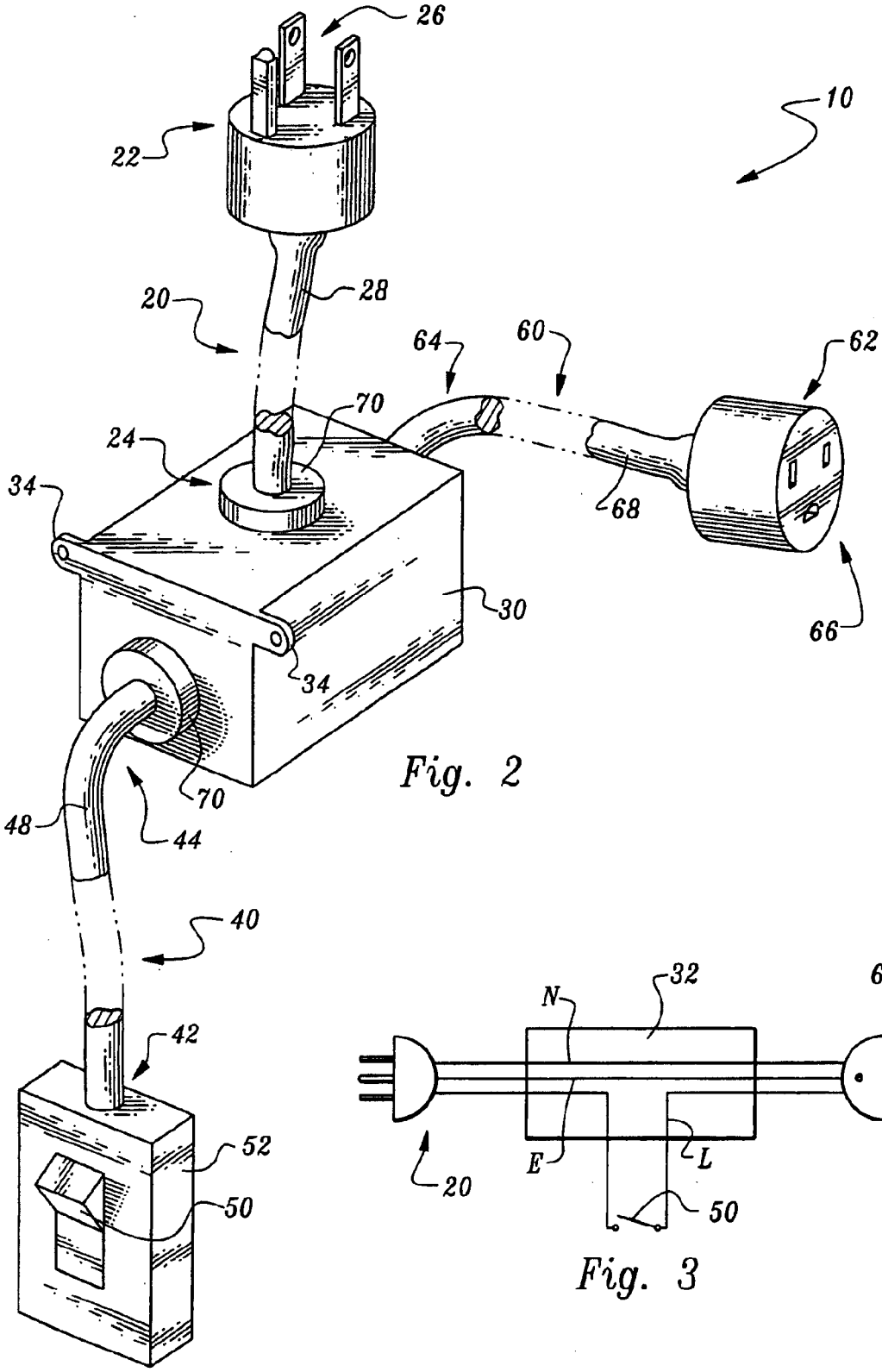
FIG. 2 is a perspective view of the invention, illustrating the junction box, switch box, power cord and conductor cord.
FIG. 3 is a diagrammatic view of the electrical circuitry pathway of this invention.

In essence and with particular reference to FIGS. 1 and 2, the garage door opener security device 10 is a power-interrupting switch 50 interposed along an electrically conductive pathway between a power source P, such as an AC outlet, and a garage door opener O. At the first end of the electrically conductive pathway, the device 10 is adapted to be connectable to the power source P via a power cord 20. At the second end of the electrically conductive pathway, the device 10 is adapted to be connectable to the garage door opener O via a connector cord 60. Between the power cord 20 and the connector cord 60 is a junction box 30 that houses the electrical circuitry 32 (FIG. 3) joining the power cord 20 to the connector cord 60. The switch 50 is conveniently suspended from the junction box 30 at a desired overhead location through a conductor cord 40, in a manner that allows an operator H to manually operate the switch 50 without excessive reach or other difficulty. The conductor cord 40 may be adjusted in length depending on the operator's reach.

More specifically, and with particular reference to FIG. 2, details of the power cord 20 of the garage door opener security device 10 are described. The power cord 20 includes a first end 22 and a second end 24 which are connected by a flexible cord portion 28. The first end 22 of the power cord 20 is adapted to be removably connectable to the power source P, such as with a male plug 26 with prongs configured for connection to the power source P with matching receptacle openings. The second end 24 of the power cord 20 is preferably connected to the junction box 30.

FIGS. 1 and 2 show the power cord 20 which incorporates a presently preferred embodiment of this invention. The power cord 20 is a conduit for transmitting electricity from the power source P to the other elements of the garage door opener security device 10. The flexible cord portion 28 of the power cord 20 may be any of the readily available standard flexible cords suitable for transmitting electricity, including, for example, a 18 AWG shielded PVC jacketed cord or a 18 AWG shielded neoprene jacketed cord. Typically, the cord portion 28 includes three copper wires, to provide the electrically conductive pathway through the cord portion 28. Alternatively, as few as one wire, or more than three wires could be provided. If desired, first end 22 and second end 24 of the power cord 20 may be joined by other conventional means including, for example, a rigid conduit with appropriate electrically conductive pathways or multiple cord portions for the wires. While copper is identified, other conductive materials could be readily substituted.

The male plug 26 of the first end 22 of the power cord 20 may be a standard three prong plug for connection to 110 volt AC outlet. The housing of the male plug 26 of the power cord 20 can be formed of any rigid insulative material including, for example, plastic. The flexible cord portion 28 of the power cord 20 is preferably securely and permanently attached to the male plug 26.

The power cord 20 may be any length sufficient to provide electricity from a source of power P to the junction box 30. Because many homes provide a receptacle near the opener O, a length of approximately 18 inches or less is typically adequate. It is also conceivable that the male plug 26 could be mounted to the junction box 30 and the power cord 20 eliminated entirely.

With continuing reference to FIG. 2, details of the connector of the garage door opener security device 10 are described. The connector cord 60 includes a first end 62 and a second end 64 which are connected preferably by a flexible cord portion 68. The first end 62 of the connector cord 60 is adapted to be removably connectable to the garage door opener O. Typically, the first end 62 includes a female plug 66 for connection to the garage door opener power line 80 having a standard three prong plug. The second end 64 of the connector cord 60 is connected to the junction box 30.

FIGS. 1 and 2 show the connector cord 60 which incorporates a presently preferred embodiment of this invention. The connector cord 60 is a pathway for transmitting electricity from the junction box 30 to the garage door opener O. The garage door opener O includes a garage door opener drive motor having a garage door opener power line 80 which requires electric power from the power source P. The garage door opener power line 80 typically includes a standard three prong plug for connection to an AC outlet. The female plug 66 of the first end of the connector cord 60 is adapted to be connectable to the three prong plug of the garage door opener power line 80. If necessary, the female plug 66 can be altered to accept the plug of the opener power line 80.

The first end 62 and the second end 64 of the connector cord 60 are joined preferably by a flexible cord portion 68, in a manner similar to that of the power cord 20. The flexible cord portion 68 of the connector cord 60 may be any of the readily available standard flexible cords suitable for transmitting electricity. Alternatively, first end 62 and second end 64 of the connector cord 60 may be joined by other conventional means including, for example, a rigid conduit or multiple cords.

The female plug 66 of the first end 62 of the connector cord 60 may be a standard three hole plug for connection to a standard three prong plug including, preferably, the three prong plug of a garage door opener power line 80. The housing of the female plug 66 of the connector cord 60 may be formed of any rigid insulative material including, for example, plastic. The flexible cord portion 68 of the connector cord 60 is preferably permanently attached to the female plug 66.

The connector cord 60 may be any length sufficient to provide electricity from the junction box 30 to the garage door opener power line 80. Typically a length of approximately 4 inches is sufficient. It is also conceivable that the female plug could be mounted to the junction box, eliminating the need for the connector cord 60 entirely.

With continuing reference to FIG. 2, details of the junction box 30 of the garage door opener security device 10 are described. The junction box 30 is located between the power cord 20 and the connector cord 60, or between the male plug 26 and the female plug 66 if either (or both) of the cords 20, 60 are omitted. The junction box 30 houses the electrical circuitry 32 (FIG. 3) to join the power cord 20 to the connector cord 60 and to accommodate the switch 50. The junction box 30 may include overhead mounting tabs 34 or other suitable fasteners to mount the junction box 30 at the desired overhead location in the garage G. Alternatively, the junction box 30 can be suspended from the opener O and power source P and may be within its own housing or incorporated into one of the cords 20, 60.

FIGS. 1 and 2 show the junction box 30. In a presently preferred embodiment of this invention, the junction box 30 is preferably a 2¾×4½×2 inch orthorhombic shaped enclosure made of plastic material with a removable cover on one of the longest surfaces to enclose the box 30. The junction box 30 preferably includes three cord receiving receptacles with at least one receptacle each for the power cord 20, connector cord 60 and conductor cord 40 described in detail below. Alternatively, any other suitably sized and shaped housings and containers with at least three cord receiving receptacles typically used for electrical wiring can be used. It is also conceivable that no box 30 would be provided, but rather the cords 20, 40, 60 could be joined together with the appropriate conducting pathways routed as needed to provide the function of this invention. Also, the junction box 30 could have the male plug 26 and/or female plug 66 built into a surface of the junction box with the cords 20, 60 eliminated. As another alternative, the box 30 can be in the form of a mass of injection molded plastic with either a hollow core containing the described wiring or with the wiring embedded within the plastic (either along with an insulation jacket or with the plastic acting as the insulation). Such an injection molded box 30 variation could be used in conjunction with each of the various corded or cordless alternatives described above and below.

FIG. 3 shows the electrical circuitry 32 which incorporates a presently preferred embodiment of this invention. The electrical circuitry 32 is preferably a typical three-wire colinear conductive unit including a neutral wire N, line wire L and ground wire E. Any functionally equivalent wiring system could similarly be used. In order to provide for an adjustably-suspended, power-interrupting switch 50, the line wire L is diverted away from the three-wire colinear unit through the receiving receptacle designated for the conductor cord 40. Thus, the line wire L runs through the conductor cord 40 toward the switch 50, is openable at the point of contact of the switch 50, and runs back through the conductor cord 40 toward the junction box 30. Once the line wire L is received back into the junction box 30, the line wire L becomes colinear again with the neutral wire N and ground wire E by continuing through the connector cord 60 and forming the second end of the electrically conductive pathway.

The junction box 30 may include overhead mounting tabs 34, each with a mounting hole therein for receiving a screw to facilitate mounting of the junction box 30 to the garage rafters R (FIG. 1). FIG. 2 shows a junction box 30 with upper mounting tabs 34. Alternatively, other fasteners may be used to mount the junction box 30 to garage rafters R, and garage ceilings and roofs. It is also conceivable that the entire device 10 could be suspended from the opener O and power source P with no direct attachment to the rafters R or other structures.

The garage door opener security device 10 further preferably includes a conductor cord 40 having a first end 42 and a second end 44 which are preferably connected by a flexible cord portion 48, and a conductor cord length-adjustment fastener 46. The first end 42 of the conductor cord 40 is connected to the switch 50. The second end 44 of the conductor cord 40 is connected to the junction box 30.

FIGS. 1 and 2 show the conductor cord 40 which incorporates a presently preferred embodiment of this invention. The conductor cord 40 is a conduit for diverting the flow of electricity away from the junction box 30 to the switch 50. The first end 42 and the second end 44 of the conductor cord 40 may be joined by a flexible cord portion 48. The flexible cord portion 48 of the conductor cord 40 may be any of the readily available standard flexible cords suitable for transmitting electricity down to the switch 50 and back up from the switch 50. The conductor cord 40 only requires two conductive wires, rather than the three wires preferred for the cords 20, 60, including a first wire extending down to the switch and a second wire extending up from the switch 50.

The conductor cord 40 further preferably includes a conductor cord length-adjustment fastener 46. The length-adjustment fastener 46 of the conductor cord 40 may be any suitable fastener for adjusting the length of the conductor cord 40 thereby accommodating for the operator's H height and reach. By fastening at least a portion of the conductor cord 40 at a desired overhead location with the length-adjustment fastener 46, the length of the conductor cord 40 becomes selectively adjustable for the operator H. FIG. 1 shows one embodiment of the conductor cord length-adjustment fastener 46 as a clip fastened to a garage rafter R, providing a means for adjusting the length of the conductor cord 40.

The conductor cord 40 may be any length sufficiently long to enable further adjustment with the conductor cord length-adjustment clip 46. The conductor cord 40 is beneficially at least one foot long to allow a majority or at least a significant minority to reach the switch 50. Most preferably a length of approximately 32 inches is provided, leaving extra cord 40 for the length adjustment clip 46 to deliver a wide range of switch 50 heights.

The garage door security device 10 may include a plurality of cord strain reliefs 70. The cord strain reliefs 70 can be mounted to any or all of the cords, including the power cord 20, connector cord 60 and conductor cord 40 at the receiving receptacles of the junction box 30. The cord strain reliefs 70 provide flexibility and slack for the power cord 20, connector cord 60 and conductor cord 40 while preventing damage to the device 10 if cords 20, 40, 60 are pulled.

The garage door opener security device 10 further includes a power-interrupting switch 50. The power-interrupting switch 50, in its basic form has two conditions of operation: an "open" position where contacts do not touch and an electrical connection is interrupted; and a "closed" position where the contacts physically touch and an electrical connection is completed.

Referring to FIG. 3, the power-interrupting switch 50 is in the "open" position thereby deactuating the power flow to the garage door opener O. When the switch 50 is in the "open" position, the garage door opener O is de-energized. With the flow of electricity interrupted, the garage door becomes disabled, preventing the garage door from being opened from the outside of the garage G by an unauthorized remote control signal. The operator H, if desired, may manually open the garage door from the interior of the garage G. In addition, the operator H may manually toggle the switch 50 to the "closed" position to reenergize the garage door opener O and complete the flow of electricity, thereby readying the garage door opener O for a remote control signal.

The switch 50 may be mounted in a sealed manner in a switch box 52. Any other suitably sized and shaped housings and containers for mounting a switch 50 can be used. Preferably, as shown in FIG. 2, the switch 50 can have an operating manually activatable portion extending outside the switch box 52. The switch box 52 can have an on/off label to indicate the position of the switch 50, also. The manually activatable portion shown provides one form of a means to manually adjust said switch 50. Other alternatives that could equivalently perform this switch adjusting function include push-button linear switches, pull cord switches (described in more detail below), touch pad switches, voice/sound activated switches, and other switches for opening and closing an electric circuit at the direction of a user.

The present invention works in combination with a standard automatic electric garage door opener O (FIG. 1) that drives the door upward or downward when a drive motor is actuated in response to receipt of an electrical signal usually generated by a manual push-button or by a radio transmitter type control. The garage door opener having a drive motor 0 is suitably supported from the rafters R or the ceiling of the garage G, by garage door opener overhead support members S. The garage door opener security device 10 is mounted at the desired overhead location to facilitate a connection between the power source P and the garage door opener O having a garage door opener power line 80. The suspension of the power-interrupting switch 50 may be further adjusted by adjusting the length of the conductor cord 40 using the conductor cord length-adjustment fastener 46.

In use and operation, when the garage door opener O receives the signal or stimulus required for opening the door, the garage door (not shown) opens and the operator H may enter the interior of the garage G through the open garage door. Once inside the garage G, and free and clear from the garage door, the operator H closes the door by the using the necessary signal or stimulus.

After the garage door closes, if the operator H wishes to disable the opener O for greater security, the operator H activates the power-interrupting switch 50 of the present invention by manually toggling the switch 50. The switch 50 is preferably arranged between the power source P and the garage door opener O in a manner such that it is within the operator's H visibility and accessibility upon walking from an automobile in the garage G to an interior door leading to the house. Such arrangements may include, but are not limited to suspending the power-interrupting switch 50 from the conductor cord 40 in a location: directly overhead of the driver's side car door, directly in the path taken from exiting the vehicle to the door entering the interior of the house, or directly overhead the doorway entering the interior of the house. When the operator H wishes to drive the vehicle again, the operator H will pass the switch 50 and be reminded to first reactuate the opener O by toggling the switch 50. The opener O can then open the garage door, such as with the remote control inside the operator's automobile.

In an alternative embodiment of the invention, the device 10 may include a plurality of connector cords 60 to accommodate larger garages having two or more doors. The power-interrupting switch 50 may be placed between the power source and two or more garage door openers 0. Each of the plurality of connector cords 60 may be adapted to be connectable to each of the garage door opener power cords 80. In this embodiment the junction box 30 may be larger in dimension and include a cord receiving receptacle to accommodate a plurality of connector cords 60. The electrical circuitry 32 may include a plurality of sets of three-wire colinear conductive units to be wired through each of the plurality of connector cords 60.

In another alternative embodiment of the invention, the conductor cord 40 and switch 50 are replaced by a pull-chain type switch or a pull-cord and handle. The pull cord/chain would not carry electric current. Rather, it would merely dangle down to a height where a user could reach it. The switch, although still interposed between the power source P and the garage door opener O, is not necessarily itself suspended below the electric connectors of the device 10, and within the operator's reach. Instead, a pull-chain/cord portion of the switch is suspended in the desired overhead location which functions just the same as the preferred embodiment. At a minimum at least a manually adjustable portion of the switch 50 is located below the power source P and garage door opener O.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion a fashion which allows pivoting, flexing, bending, sliding or other relative motion while still providing some form of attachment.

What is claimed is:

1. A garage door opener security device for selectively interrupting the flow of electricity from an electric power source to a garage door opener, comprising in combination:

an electrically conductive pathway adapted to be connectable between the power source and the garage door opener, to deliver electric power from the power source to the garage door opener;

a power-interrupting switch interposed along said electrically conductive pathway, said switch adapted to selectively complete and interrupt the flow of electricity between the garage door opener and the power source; and wherein at least a manually activatable portion of said switch is adapted to be locatable below said electrically conductive pathway such that an operator can reach said switch when said electrically conductive pathway is further from the operator.

2. The device of claim 1 wherein said electrically conductive pathway includes a power cord having a first end including a male plug for connection to the power source, said pathway having a female plug adapted to removably connect to the garage door opener, said female plug spaced from said first end of said power cord.

3. The device of claim 2 wherein said electrically conductive pathway includes a connector cord having said female plug thereon, said female plug adapted to connect to a power line of the garage door opener, said connector cord coupled to said power cord with said power-interrupting switch between said power cord and said connector cord.

4. The device of claim 1 wherein said power-interrupting switch further includes a conductor cord having a first end connected to said switch, and a second end interposed upon said electrically conductive pathway.

5. The device of claim 4 wherein a junction box is interposed upon said electrically conductive pathway, said box including at least three cord receiving receptacles.

6. The device of claim 5 wherein at least a portion of said switch further includes a length-adjustment fastener for adjusting a length of the conductor cord.

7. The device as set forth in claim 5 wherein said switch further includes a switch housing, such that said switch is mounted in a sealed manner in the switch housing having an operating portion extending outside the switch housing.

8. An appliance for selectively de-powering an automatic garage door opener, comprising in combination:

a first electric connector;

said first electric connector adapted to be removably coupled to a source of electric power;

a second electric connector;

said second electric connector electrically coupled to said first electric connector;

said second electric connector adapted to be removably coupled to the garage door opener;

a switch interposed between said first electric connector and said second electric connector;

said switch adapted to be manually adjusted between an open position electrically decoupling said first electric connector from said second electric connector and a closed position electrically coupling said first electric connector to said second electric connector; and at least a portion of said switch adapted to be suspended below said first electric connector and said second electric connector.

9. The appliance of claim 8 wherein said first electric connector includes a male plug.

10. The appliance of claim 9 wherein said second electric connector includes a female plug.

11. The appliance of claim 8 wherein a junction is interposed between said first electric connector and said second electric connector, said junction coupled to said switch and at least as close to said switch as said first electric connector and said second electric connector.

12. The appliance of claim 11 wherein a power cord is interposed between said first electric connector and said junction.

13. The appliance of claim 12 wherein a connector cord is interposed between said junction and said second electric connector.

14. The appliance of claim 13 wherein a conductor cord is interposed between said switch and said junction.

15. The appliance of claim 14 wherein said conductor cord includes a first end adjacent said switch and a second end adjacent said junction; and wherein a fastener is slidably attached to said conductor cord between said first end and said second end, said fastener adapted to be coupled to a structure overlying a garage space with said conductor cord slidably positionable relative to said fastener, such that a length of said conductor cord between said switch and said fastener is adjustable.

16. The appliance of claim 11 wherein said switch is adjacent said junction and a switch cord extends down from said switch, said switch cord adapted to cause said switch to be manually toggled when said switch cord is pulled.

17. The appliance of claim 11 wherein at least one of said electric connectors is a plug adjacent said junction.

18. The appliance of claim 17 wherein both of said electric connectors are plugs adjacent said junction.

19. The appliance of claim 17 wherein a conductor cord is interposed between said switch and said junction.

20. The appliance of claim 19 wherein said conductor cord includes a first end adjacent said switch and a second end adjacent said junction; and wherein a fastener is slidably attached to said conductor cord between said first end and said second end, said fastener adapted to be coupled to a structure overlying a garage space with said conductor cord slidably positionable relative to said fastener, such that a length of said conductor cord between said switch and said fastener is adjustable.

21. The appliance of claim 17 wherein said switch is adjacent said junction and a switch cord extends down from said switch, said switch cord adapted to cause said switch to be manually toggled when said switch cord is pulled.

22. A garage door disabling apparatus, comprising in combination:

a first electric connector;

said first electric connector adapted to be removably coupled to a source of electric power;

a second electric connector;

said second electric connector electrically coupled to said first electric connector;

said second electric connector adapted to be removably coupled to the garage door opener;

a switch interposed between said first electric connector and said second electric connector;

means to manually adjust said switch between an open position and a closed position; and said means to manually adjust said switch located at least partially below said first electric connector and said second electric connector.

23. The apparatus of claim 22 wherein said means to manually adjust said switch includes a toggleable switch located at an end of a connector cord extending down from a junction between said first electric connector and said second electric connector, said connector cord electrically coupled to both said first electric connector, said second electric connector and said toggleable switch.

24. The apparatus of claim 22 wherein said means to manually adjust said switch includes an end of a pull cord coupled to said switch and extending below said first electric connector and said second electric connector.

25. The apparatus of claim 22 wherein said means to manually adjust said switch is located at least one foot below said first electric connector and said second electric connector.

* * * * *